US009340753B2

(12) United States Patent
Tang et al.

(10) Patent No.: US 9,340,753 B2
(45) Date of Patent: May 17, 2016

(54) LOW SURFACTANT, HIGH CARBONATE LIQUID LAUNDRY DETERGENT COMPOSITIONS WITH IMPROVED SUDS PROFILE

(71) Applicant: The Procter & Gamble Company, Cincinnati, OH (US)

(72) Inventors: Ming Tang, Beijing (CN); Qing Chen, Beijing (CN); Liyuan Niu, Beijing (CN); Bing Xu, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/708,328

(22) Filed: May 11, 2015

(65) Prior Publication Data

US 2015/0337236 A1 Nov. 26, 2015

(30) Foreign Application Priority Data

May 20, 2014 (WO) ..... PCT/CN2014/077848

(51) Int. Cl.

| | |
|---|---|
| ***C11D 1/22*** | (2006.01) |
| ***C11D 1/37*** | (2006.01) |
| ***C11D 1/65*** | (2006.01) |
| ***C11D 1/83*** | (2006.01) |
| ***C11D 3/10*** | (2006.01) |
| ***C11D 7/50*** | (2006.01) |
| ***C11D 1/14*** | (2006.01) |
| ***C11D 3/20*** | (2006.01) |
| ***C11D 11/00*** | (2006.01) |
| *C11D 1/62* | (2006.01) |
| *C11D 1/72* | (2006.01) |
| *C11D 1/75* | (2006.01) |

(52) U.S. Cl.

CPC *C11D 1/143* (2013.01); *C11D 1/22* (2013.01); *C11D 3/10* (2013.01); *C11D 3/2041* (2013.01); *C11D 3/2065* (2013.01); *C11D 3/2068* (2013.01); *C11D 11/0017* (2013.01); *C11D 1/146* (2013.01); *C11D 1/37* (2013.01); *C11D 1/62* (2013.01); *C11D 1/65* (2013.01); *C11D 1/72* (2013.01); *C11D 1/75* (2013.01); *C11D 1/83* (2013.01)

(58) Field of Classification Search

CPC ..... C11D 1/22; C11D 1/37; C11D 1/65; C11D 1/83; C11D 3/10; C11D 3/2041; C11D 3/2065; C11D 7/50; C11D 7/5004; C11D 7/5081; C11D 11/0017

See application file for complete search history.

(56) References Cited

U.S. PATENT DOCUMENTS

| | | | | |
|---|---|---|---|---|
| 4,175,062 | A | 11/1979 | Disch et al. | |
| 5,061,396 | A * | 10/1991 | Lovine | C11D 3/3757 510/321 |
| 5,443,751 | A | 8/1995 | Mazzola | |
| 6,369,015 | B1 | 4/2002 | Groot et al. | |
| 2001/0014655 | A1 | 8/2001 | Moster et al. | |
| 2005/0181965 | A1* | 8/2005 | Hsu | C11D 17/0004 510/357 |
| 2010/0234323 | A1* | 9/2010 | Holzl | A01N 37/04 514/63 |
| 2013/0071910 | A1* | 3/2013 | Wieland | C11D 3/38618 435/263 |

FOREIGN PATENT DOCUMENTS

| | | | |
|---|---|---|---|
| CN | 1370819 | A | 9/2002 |
| DE | 2203004 | A1 | 8/1972 |
| WO | WO98/50518 | A1 | 11/1998 |
| WO | WO2004/059700 | A2 | 7/2004 |
| WO | WO2007/018317 | A1 | 2/2007 |
| WO | WO2011/114875 | A1 | 9/2011 |
| WO | WO2011/114876 | A1 | 9/2011 |

OTHER PUBLICATIONS

International Search Report for Application No. PCT/CN2014/077848, dated Feb. 27, 2015, containing 8 pages.

* cited by examiner

*Primary Examiner* — Charles Boyer

(74) *Attorney, Agent, or Firm* — Melissa Krasovec; Leonard W Lewis; Steve W Miller

(57) ABSTRACT

The present invention relates to a stable liquid laundry detergent composition containing low levels of a $C_{10}$-$C_{20}$ linear alkyl benzene sulphonate surfactant in combination with high levels of a water-soluble alkali metal carbonate for achieving improved suds profile.

14 Claims, No Drawings

LOW SURFACTANT, HIGH CARBONATE LIQUID LAUNDRY DETERGENT COMPOSITIONS WITH IMPROVED SUDS PROFILE

FIELD OF THE INVENTION

The present invention relates to liquid laundry detergents containing relatively low levels of anionic surfactants in combination with relatively high levels of a water-soluble alkali metal carbonate in a stable formulation (i.e., with little or no phase separation). Despite the low surfactant level, such liquid laundry detergents nevertheless exhibits an optimal sudsing profile, i.e., relatively high wash suds volume and relatively low rinse suds volume, which is particularly desirable for hand washing of fabrics because it allows consumers to experience ample suds during the wash cycle while enabling easy rinse in subsequent rinse cycles.

BACKGROUND OF THE INVENTION

Laundry detergents comprising anionic detersive surfactants for cleaning fabrics have been known for many years. Historically, cleaning laundry was defined primarily as a process that involved removal of stains. Consistent with this historical approach to cleaning, laundry detergent designers focused on formulating with large amounts of anionic surfactants to ensure maximum surface activity of the surfactants to achieve the most removal of soil. However, to rinse off such laundry detergents with high surfactant levels require a large amount of water and multiple rinse cycles, which poses a challenge for consumers living in areas where water is scarce. Further, as the modern society becomes more and more conscious of the environmental impact of synthetic surfactants and cleaning additives, there is a continuing need for laundry detergents and cleaning compositions with lower levels of surfactants while still maintaining the cleaning benefits thereof.

Consumers typically view copious suds in the wash as the primary and most desirable signal of cleaning. High suds are especially desirable during hand washing of fabrics, since the consumer can directly feel and touch the suds generated during the wash cycle and will intuitively correlates the high suds volume with the achievement of sufficient fabric cleaning. As fabrics, consumer habits and chemistries evolve, consumers are recognizing that cleaning of soils off fabrics is no longer the only or even biggest challenge they meet. As consumers become more sophisticated, they are recognizing that surfactants that generate copious suds in the wash also do not rinse well and tend to leave chemical residues on fabrics. Therefore, if suds are still present during the rinse, then the consumers immediately infer from it that there may still be surfactant residue on the fabrics and that the fabrics are not yet "clean". As a result, the consumers feel the need to rinse the fabrics multiple times in order to make sure that the surfactants are removed as thoroughly as other soils. Hence, while a large volume of suds is desirable during the wash cycle of fabric cleaning, it is paradoxically undesirable during the rinse cycle.

Linear alkyl benzene sulphonate (LAS) is one of the most commonly used anionic surfactants in laundry detergents. Although sufficient cleaning can be achieved by using detergent compositions with relatively lower levels of LAS, e.g., 20 wt % or less, the volume of suds generated by such detergent compositions is significantly reduced. The reduced suds volume during the wash cycle will inevitably perceived by the consumers as ineffective cleaning, which is in turn correlated with inferior quality of the laundry detergents used. In order to avoid such negative consumer perception, one or more co-surfactants can be added into the detergent compositions to boost suds volume during the wash cycle for detergent compositions containing relatively lower levels of LAS surfactant. Alkylethoxy sulfates (AES) are particularly effective in boosting wash suds volume when used in combination with LAS. However, AES tends to leave a significant amount of suds after the wash cycle, and laundry detergent compositions containing AES require multiple rinses for complete elimination of the suds.

There is therefore a continuing need for an improved laundry detergent composition, particularly a stable liquid laundry detergent composition, which contains relatively lower levels of LAS with little or no AES, but which is tuned to provide an optimal sudsing profile, i.e., a sufficiently high level of suds during the wash (signaling effective cleaning) and subsequently a reduced suds volume during the rinse, so that consumers perceive the surfactants as capable of being easily rinsed away, preferably in a single rinse cycle.

SUMMARY OF THE INVENTION

The present invention in one aspect relates to a liquid laundry composition that contains: (a) from about 5 wt % to about 20 wt % of a $C_{10}$-$C_{20}$ linear alkyl benzene sulphonate (LAS); (b) from about 2 wt % to about 10 wt % of a water-soluble alkali metal carbonate; (c) from about 5 wt % to about 40 wt % of one or more solvents selected from the group consisting of diols and combinations thereof; (d) from 5 wt % to 20 wt % of Glycerin, while such liquid laundry detergent composition is substantially free of alkylethoxy sulfates (AES).

The liquid laundry detergent composition described hereinabove may further contain from about 0.1 wt % to about 15 wt % of a $C_8$-$C_{18}$ linear or branched alkyl sulfate (AS). Preferably, such liquid laundry detergent composition contains from about 0.5 wt % to about 8 wt % of a $C_{10}$-$C_{16}$ linear or branched AS.

The liquid laundry detergent composition may also contain from about 0.01 wt % to about 2 wt % of a cationic surfactant selected from the group consisting of dimethyl hydroxyethyl lauryl ammonium chloride, trimethyl lauryl ammonium chloride, amido propyldimethyl amine, and combinations thereof. It is particularly preferred to incorporate from about 0.1 wt % to about 1 wt % of dimethyl hydroxyethyl lauryl ammonium chloride and/or trimethyl lauryl ammonium chloride into such liquid laundry detergent composition.

Further, the liquid laundry detergent composition of the present invention may include from about 0.01 wt % to about 5 wt % of a nonionic surfactant selected from the group consisting of $C_8$-$C_{18}$ amine oxides, $C_8$-$C_{18}$ alcohol alkoxylates having an average degree of alkoxylation from about 1 to about 20, and combinations thereof. Particularly preferred nonionic surfactants are $C_{10}$-$C_{16}$ alkyl dimethyl amine oxide, which may present in such liquid laundry detergent composition at an amount ranging from about 0.1 wt % to about 2 wt %. $C_{12}$-$C_{14}$ alcohol ethoxylates having an average degree of ethoxylation ranging from about 7 to about 9 are also preferred, which may be present in the composition at an amount ranging from about 0.1 wt % to about 1 wt %.

One or more acids, such as citric acid, boric acid, and combinations thereof, can be incorporated into the liquid laundry detergent composition in the amount ranging from about 0.1 wt % to about 10 wt %. Preferably, the liquid laundry detergent composition contains from about 1 wt % to about 5 wt % of citric acid and/or from about 1 wt % to about 3 wt % of boric acid.

In addition, fatty acids, particularly $C_{12}$-$C_{18}$ fatty acids, or salts thereof can be included in the liquid laundry detergent composition of the present invention. The total amount of such fatty acids or salts may range from about 0.1 wt % to about 5 wt %, preferably from about 0.5 wt % to about 4 wt %, and more preferably from about 0.7 wt % to about 3 wt %.

In another aspect, the present invention relates to a liquid laundry detergent composition containing: (a) from about 8 wt % to about 18 wt % of a monoethanolamine LAS and/or 2-aminopropanol LAS; (b) from about 4 wt % to about 7 wt % of sodium carbonate; (c) from about 15 wt % to about 35 wt % of propylene glycol; (d) from about 6 wt % to about 18 wt % of glycerin; and (e) from about 0.7 wt % to about 5 wt % of a $C_{10}$-$C_{16}$ linear or branched AS, while such liquid laundry detergent composition is substantially free of alkylethoxy sulfates.

In yet another aspect, the present invention relates to use of the above-described liquid laundry detergent compositions for hand-washing fabrics to achieve optimized sudsing profile.

These and other aspects of the present invention will become more apparent upon reading the following detailed description of the invention.

DETAILED DESCRIPTION OF THE INVENTION

Features and benefits of the various embodiments of the present invention will become apparent from the following description, which includes examples of specific embodiments intended to give a broad representation of the invention. Various modifications will be apparent to those skilled in the art from this description and from practice of the invention. The scope of the present invention is not intended to be limited to the particular forms disclosed and the invention covers all modifications, equivalents, and alternatives falling within the spirit and scope of the invention as defined by the claims.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

As used herein, the term 'liquid" includes liquid, paste, wax, gel, and mixtures thereof, including liquid compositions packaged in water-soluble capsules or pouches, which are preferably characterized by a viscosity ranging from about 0.1 Pa·S to about 10 Pa·S (i.e., from about 100 cps to about 10,000 cps) when measured at about 50° C. and at a shear rate of about 25 $s^{-1}$. The liquid composition may comprise one or more solids suspended therein, including powders or agglomerates, e.g., micro-capsules, beads, noodles, or pearlized balls. Such solids may provide a technical benefit or an aesthetic effect.

As used herein, the terms "consisting essentially of" means that the composition contains less than about 5%, preferably less than about 1%, of ingredients other than those listed.

Further, the terms "essentially free of," "substantially free of" or "substantially free from" means that the indicated material is present in the amount of from 0 wt % to about 0.5 wt %, or preferably from 0 wt % to about 0.1 wt %, or more preferably from 0 wt % to about 0.01 wt %, and most preferably it is not present at analytically detectable levels.

As used herein, the term "water-soluble" refers to a solubility of more than about 30 grams per liter (g/L) of deionized water measured at 20° C. and under the atmospheric pressure.

As used herein, "suds" indicates a non-equilibrium dispersion of gas bubbles in a relatively smaller volume of a liquid. The terms like "suds", "foam" and "lather" can be used interchangeably within the meaning of the present invention.

As used herein, "suds profile" or "sudsing profile" refers to the properties of a detergent composition relating to suds character during the wash and rinse cycles. The suds profile of a detergent composition includes, but is not limited to, the speed of suds generation upon dissolution in the laundering liquor, the volume and retention of suds in the wash cycle, and the volume and disappearance of suds in the rinse cycle. Preferably, the suds profile includes the Wash Suds Height and Rinse Suds Height as specifically defined by the testing methods disclosed hereinafter in the examples. It may further include additional suds-related parameters, such as suds stability measured during the washing cycle and the like.

As used herein, all concentrations and ratios are on a weight basis unless otherwise specified. All temperatures herein are in degrees Celsius (° C.) unless otherwise indicated. All conditions herein are at 20° C. and under the atmospheric pressure, unless otherwise specifically stated. All polymer molecular weights are by average number molecular weight unless otherwise specifically noted.

It has been a surprising and unexpected discovery that water-soluble alkali metal salts, such as sodium carbonate, potassium carbonate, sodium bicarbonate, and potassium bicarbonate, can be used in combination with LAS to boost suds volume during the wash cycle. Correspondingly, lesser amount of LAS can be used in the laundry detergent compositions to achieve the same volume of wash suds desired for signaling effective cleaning to consumers. Unlike AES, the water-soluble alkali metal salts can be used rinsed off, leaving little or no additional suds during the rinse cycle. As a result, laundry detergent compositions containing low levels of LAS and high levels of water-soluble alkali metal salts are characterized by significantly reduced rinse suds volume, in comparison with compositions containing low levels of LAS and high levels of AES. In order to avoid potential phase separation that may be caused by the high levels of water-soluble alkali metal salts and ensure stability of the liquid laundry detergent compositions, a specific solvent system containing mostly diols is provided for stabilizing the alkali metal salts.

Detergent Composition

As used herein the phrase "detergent composition" includes compositions and formulations designed for cleaning or treating fabrics or similar flexible materials consisting of a network of natural or artificial fibers, including natural, artificial, and synthetic fibers, e.g., cotton, linen, wool, polyester, nylon, silk, acrylic, or blends thereof. Such detergent compositions include, but are not limited to, laundry cleaning compositions, fabric softening compositions, fabric enhancing compositions, fabric freshening compositions, laundry prewash, laundry pre-treat, laundry additives, spray products, dry cleaning agents or compositions, laundry rinse additives, wash additives, post-rinse fabric treatment compositions, ironing aids, unit dose formulations, delayed delivery formulations, liquid hand dishwashing compositions, detergents contained on or in a porous substrate or nonwoven sheet, and other suitable forms that may be apparent to one skilled in the art in view of the teachings herein. Such detergent compositions may be used as a pre-laundering treatment, a post-laundering treatment, or may be added during the rinse or wash cycle of the laundering operation.

The laundry detergent composition is preferably a liquid laundry detergent and can be a fully formulated laundry detergent product. Liquid compositions contained in encapsulated and/or unitized dose products are included, as are compositions which comprise two or more separate but jointly dispensable portions. More preferably, the laundry detergent composition is a liquid laundry detergent composition designed for hand-washing, where the improved suds benefit or superior sudsing profile is most evident to the consumer.

The liquid laundry detergent composition of the present invention has a viscosity from about 1 to about 2000 centipoise (1-2000 mPa·s), or from about 200 to about 800 centipoises (200-800 mPa·s). The viscosity can be determined using a Brookfield viscometer, No. 2 spindle, at 60 RPM/s, measured at 25° C.

The liquid detergent composition of the present invention is preferably characterized by a pH value ranging from about 8.5 to about 13, and preferably from about 9 to about 11.

Preferably, the detergent compositions are provided as single-phase liquid products that are stable, i.e., with no visible phase separation when placed at 5° C., 22° C. and 40° C., respectively, and under atmospheric pressure for at least 24 hours or more.

Surfactants

The laundry detergent compositions of the present invention may comprise one or more surfactants, including anionic, nonionic, zwitterionic, amphoteric and/or cationic surfactants, which can be used either alone or as compatible mixtures thereof. Preferably, the total amount of surfactants in the liquid laundry detergent compositions of the present invention ranges from about 5% to about 30%, more preferably from about 10% to about 25%, by total weight of the compositions. The total surfactant content in the liquid laundry detergent compositions of the present invention is limited at such a relatively lower level, so as to minimizing the environmental impact of such detergent compositions while delivering satisfactory cleaning benefits to the consumers.

Synthetic anionic surfactants such as $C_{10}$-$C_{20}$ linear alkyl benzene sulphonates (LAS) are used in the present invention as the primary surfactant. Typical LAS used in laundry detergents are formed by neutralizing an acid precursor of LAS (which is referred to as HLAS) with an inorganic base compound such as sodium hydroxide or sodium carbonate, thereby resulting in NaLAS. In the practice of the present invention, however, it is preferred that the LAS formed by neutralizing HLAS with an organic base compound, such as monoethanolamine (MEA), 2-aminopropanol (2-AP), monoisopropanolamine ("MIPA" or "1-amino-2-propanol"), 1-amino-3-propanol, or a mixture thereof. Preferably, the LAS is monoethanolamine LAS and/or 2-aminopropanol LAS, which helps to further improve the solubility of LAS in the mixed solvent.

The LAS as mentioned hereinabove can be provided in the liquid laundry detergent composition of the present invention in an amount ranging from about 5 wt % to about 20 wt %, preferably from about 10 wt % to about 15 wt %.

Other anionic surfactants can also be used in the liquid laundry detergent composition of the present invention, except alkylethoxy sulfates (AES). As mentioned hereinabove, although AES is effective in boosting the suds volume during the wash cycle when used in combination with LAS, it tends to leave excessive suds during the rinse cycle and render the detergent compositions difficult to remove from the fabric without several rinses. Therefore, it is preferred that the liquid laundry detergent composition of the present invention is substantially free of AES, i.e., containing no more than 0.5% of AES, preferably no more than 0.1%, and more preferably no more than 0.01% by total weight of the composition.

Other anionic surfactants that can be used for practice of the present invention include, for example, water-soluble salts of the higher fatty acids, i.e., "soaps." This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap. Additional non-soap anionic surfactants which are suitable for use herein include: (a) the sodium, potassium and ammonium alkyl sulfates with either linear or branched carbon chains, especially those obtained by sulfating the higher alcohols ($C_8$-$C_{18}$ carbon atoms), such as those produced by reducing the glycerides of tallow or coconut oil; (b) the sodium, potassium and ammonium alkyl sulphonates in which the alkyl group contains from about 10 to about 20 carbon atoms in either a linear or a branched configuration; (c) the sodium, potassium and ammonium alkyl phosphates or phosphonates in which the alkyl group contains from about 10 to about 20 carbon atoms in either a linear or a branched configuration, (d) the sodium, potassium and ammonium alkyl carboxylates in which the alkyl group contains from about 10 to about 20 carbon atoms in either a linear or a branched configuration, and combinations thereof.

Especially preferred for the practice of the present invention are $C_8$-$C_{18}$ linear or branched alkyl sulfate (AS), and more preferably are $C_{10}$-$C_{16}$ linear or branched AS, which can be present in the liquid laundry detergent composition in the amount ranging from about 0.5 wt % to about 8 wt %, more preferably from about 0.7 wt % to about 5 wt %. In a particularly preferred embodiment of the present invention, the liquid laundry detergent compositions have a dual-surfactant system that consists essentially of LAS and AS, without little or no other surfactants. In such a dual-surfactant system, LAS may be present as the primary surfactant in the amount ranging from about 8% to about 18% by total weight of the detergent composition, while AS may be present as the secondary surfactant in the amount ranging from about 0.7% to about 5% by total weight of the detergent composition, as preferred. Alternatively, LAS may be present as the second surfactant in the smaller amount and AS may be present as the primary surfactant in the larger amount as specified hereinabove, although this arrangement is less preferred.

The liquid laundry detergent compositions of the present invention may also contain one or more cationic surfactants. Non-limiting examples of suitable cationic surfactants include: quaternary ammonium surfactants; dimethyl hydroxyethyl quaternary ammonium; dimethyl hydroxyethyl lauryl ammonium chloride; trimethyl lauryl ammonium chloride; polyamine cationic surfactants; cationic ester surfactants; and amino surfactants, specifically amido propyldimethyl amine (APA), and the like. Preferably, the liquid laundry detergent compositions of the present invention contain one or more cationic surfactants selected from the group consisting of dimethyl hydroxyethyl lauryl ammonium chloride, trimethyl lauryl ammonium chloride, amido propyldimethyl amine and combinations thereof. More preferably, the liquid laundry detergent compositions of the present invention include from about 0.1 wt % to about 1 wt % of dimethyl hydroxyethyl lauryl ammonium chloride and/or trimethyl lauryl ammonium chloride. Most preferably, such compositions contain from about 0.3 wt % to about 0.7 wt % of trimethyl lauryl ammonium chloride.

The liquid laundry detergent compositions of the present invention may further contain one or more nonionic surfactants. In some examples, the liquid laundry detergent compositions comprise from about 0.01 wt % to about 5 wt %, preferably from about 0.1% to about 2%, more preferably from about 0.1 wt % to about 1 wt %, of one or more nonionic surfactants. Suitable nonionic surfactants useful herein can include, for example, amine oxides and alcohol alkoxylates. Other non-limiting examples of nonionic surfactants useful herein include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, $BAE_x$, wherein x is from 1 to 30; alkylpolysaccharides, specifically alkylpolyglycosides; polyhydroxy fatty acid amides; and ether capped poly(oxyalkylated) alcohol surfactants.

In some specific examples, the liquid laundry detergent compositions of the present invention comprise a $C_8$-$C_{18}$ amine oxide nonionic surfactant, and specifically a $C_{10}$-$C_{16}$ alkyl dimethyl amine oxide, and the like, which is preferably present in the amount ranging from about 0.1 wt % to about 2 wt % by total weight of the detergent compositions.

The liquid laundry detergent compositions may also contain an ethoxylated nonionic surfactant, such as, for example, alcohol ethoxylates and alkyl phenol ethoxylates of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. In a specific example, the nonionic surfactant is a $C_{12}$-$C_{14}$ alcohol ethoxylated having an average degree of ethoxylation of from about 7 to about 9, which is preferably present in the amount ranging from about 0.1 wt % to about 1 wt % by total weight of the liquid laundry detergent composition of the present invention.

The liquid laundry detergent compositions of the present invention may further comprise a zwitterionic or amphoteric surfactant, such as imidazoline compounds, alkylaminoacid salts, betaine or betaine derivatives.

Water-Soluble Alkali Metal Carbonates as Suds Booster

It is a surprising and unexpected discovery of the present invention that water-soluble alkali metal salts, such as sodium carbonate, potassium carbonate, sodium bicarbonate, and potassium bicarbonate (which are all referred to as "carbonates" or "carbonate" hereinafter), can be used to boost the suds volume of LAS during the wash cycle and also provide reduced suds during the rinse cycle, thereby rendering the detergent compositions so formed very easy to rinse off without requiring multiple rinses.

Sodium carbonate is particularly preferred due to its high water solubility. Potassium carbonate, sodium bicarbonate, and potassium bicarbonate can also be used. Preferably, the liquid laundry detergent composition of the present invention contains from about 2 wt % to about 10 wt %, more preferably from about 3 wt % to about 8 wt %, of one or more carbonates as mentioned hereinabove. In a most preferred embodiment of the present invention, the detergent composition of the present invention includes from about 4 wt % to about 7 wt % of sodium carbonate.

Solvents

The liquid laundry detergent compositions of the present invention preferably comprise one or more organic solvents, which may be present in an amount ranging from about 1 wt % to about 80 wt %, preferably from about 10 wt % to about 60 wt %, more preferably from about 15 wt % to about 50 wt %, and most preferably from about 20 wt % to about 45 wt %, by total weight of the compositions.

Because a high salt content may lead to potential phase separation in liquid laundry detergent compositions, the solvent system of the present invention is particularly designed to accommodate the relatively high levels of water-soluble alkali metal carbonate and stabilize the detergent composition, thereby minimizing the risk of phase separation.

Specifically, the solvent system of the present invention is composed mostly of diols, such as ethylene glycol, diethylene glycol, propylene glycol, dipropylene glycol, butylene glycol, pentanediols, and combinations thereof. The diols are present in the liquid laundry detergent composition of the present invention in a total amount ranging from about 2 wt % to about 50 wt %. Preferably, the composition contains ethylene, diethylene glycoy, and/or propylene glycol in a total amount ranging from about 5 wt % to about 40 wt %. More preferably, the composition contains propylene glycol in the amount ranging from about 15 wt % to about 35 wt %.

Other organic solvents may also be present, which include, but are not limited to: methanol, ethanol, glycerin, sodium cumene sulfonate, potassium cumene sulfonate, ammonium cumene sulfonate, sodium toluene sulfonate, potassium toluene sulfonate, sodium xylene sulfonate, potassium xylene sulfonate, ammonium xylene sulfonate, or mixtures thereof. Other lower alcohols, such $C_1$-$C_4$ alkanolamines, e.g., monoethanolamine and/or triethanolamine, may also be used. In a particularly preferred embodiment of the present invention, the liquid laundry detergent compositions of the present invention also contain from about 5 wt % to about 20 wt %, preferably from 6 wt % to 18 wt %, more preferably from 8 wt % to 16 wt % of glycerin in addition to the diol(s).

The liquid laundry detergent composition preferably contains water in combination with the above-mentioned organic solvent(s) as carrier(s). In some embodiments, water is present in the liquid laundry detergent compositions of the present invention in the amount ranging from about 20 wt % to about 70 wt %, preferably from about 25 wt % to 60 wt %, and more preferably from about 30 wt % to about 50 wt %. In other embodiments, water is absent and the composition is anhydrous. Highly preferred compositions afforded by the present invention are clear, isotropic liquids.

Other Ingredients

In addition to the above-described ingredients, the liquid laundry detergent compositions of the present invention may comprise one or more builders. Examples of suitable builders include water-soluble alkali metal phosphates, polyphosphates, borates, citrates, and silicates; water-soluble amino polycarboxylates; water-soluble salts of phytic acid; polycarboxylates; zeolites or aluminosilicates and combinations thereof. Specific examples of these are: sodium and potassium triphosphates, pyrophosphates, orthophosphates, hexametaphosphates, tetraborates, and silicates; water-soluble salts of mellitic acid, carboxymethyloxysuccinic acid, salts of polymers of itaconic acid and maleic acid, tartrate monosuccinate, tartrate disuccinate. It may also be especially preferred for the laundry detergent powder to comprise low levels, or even be essentially free, of builder. The term "essentially free" means that the composition "comprises no deliberately added" amount of that ingredient. In a preferred embodiment, the liquid laundry detergent composition of the present invention comprises no builder.

In a preferred embodiment of the present invention, the liquid laundry detergent composition comprises from about 0.1 wt % to about 10 wt % of citric acid and/or boric acid as pH buffers. For example, citric acid may be provided in the amount ranging from about 1 wt % to about 5 wt %, and boric acid may be provided in the amount ranging from about 1 wt % to about 3 wt %.

Further, such liquid laundry detergent composition may comprise one or more fatty acids or salts thereof, preferably in the amount ranging from about 0.1 wt % to about 5 wt %, preferably from about 0.5 wt % to about 4 wt %, and more preferably from about 0.7 wt % to about 3 wt %. Suitable fatty acids include $C_{10}$-$C_{22}$ fatty acids or alkali salts thereof. Such alkali salts include monovalent or divalent alkali metal salts like sodium, potassium, lithium and/or magnesium salts as well as the ammonium and/or alkylammonium salts of fatty acids, preferably the sodium salt. Preferred fatty acids for use herein contain from 12 to 20 carbon atoms, and more preferably 12 to 18 carbon atoms. Exemplary fatty acids that can be used may be selected from caprylic acid, capric acid, lauric acid, myristic acid, myristoleic acid, palmitic acid, palmitoleic acid, sapienic acid, stearic acid, oleic acid, elaidic acid, vaccenic acid, linoleic acid, linoelaidic acid, α-linoelaidic acid, arachidic acid, arachidonic acid, eicosapentaenoic acid, behenic acid, erucic acid, and docosahexaenoic acid, and mixtures thereof. Among the above-listed saturated fatty acids, lauric acid, myristic acid and palmitic acid are particularly preferred.

The balance of the liquid detergent composition typically contains one or more adjunct ingredients. Suitable adjunct ingredients include but are not limited to: builders, chelating agents, dye transfer inhibiting agents, dispersants, rheology modifiers, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, photobleaches, structure elasticizing agents, fabric softeners, carriers, hydrotropes, processing aids, solvents, hueing agents, anti-microbial agents, free perfume oils, and/or pigments. In addition to the disclosure below, suitable examples of such other adjunct ingredients and levels of use are found in U.S. Pat. Nos. 5,576,282, 6,306,812, and 6,326,348. The precise nature of these adjunct ingredients and the levels thereof in the liquid laundry detergent composition will depend on factors like the specific type of the composition and the nature of the cleaning operation for which it is to be used.

In a particularly preferred embodiment, the liquid detergent composition herein comprises a rheology modifier (also referred to as a "structurant" in certain situations), which functions to suspend and stabilize the microcapsules and to adjust the viscosity of the composition so as to be more applicable to the packaging assembly. The rheology modifier herein can be any known ingredient that is capable of suspending particles and/or adjusting rheology to a liquid composition, such as those disclosed in U.S. Patent Application Nos. 2006/0205631A1, 2005/0203213A1, and U.S. Pat. Nos. 7,294,611, 6,855,680. Preferably, the rheology modifier is selected from the group consisting of hydroxy-containing crystalline material, polyacrylate, polysaccharide, polycarboxylate, amine oxide, alkali metal salt, alkaline earth metal salt, ammonium salt, alkanolammonium salt, $C_{12}$-$C_{20}$ fatty alcohol, di-benzylidene polyol acetal derivative (DBPA), diamido gallant, a cationic polymer comprising a first structural unit derived from methacrylamide and a second structural unit derived from diallyl dimethyl ammonium chloride, and a combination thereof.

Method of Making the Laundry Detergent Composition

Incorporation of the ingredients as described hereinabove into cleaning or laundry detergent compositions of the invention can be done in any suitable manner and can, in general, involve any order of mixing or addition.

For example, one or more of the raw materials as received from the manufacturer can be introduced directly into a preformed mixture of two or more of the other components of the final composition. This can be done at any point in the process of preparing the final composition, including at the very end of the formulating process.

In another example, one or more of the raw materials can be premixed with an emulsifier, a dispersing agent or a suspension agent to form an emulsion, a latex, a dispersion, a suspension, and the like, which is then mixed with other components of the final composition. These components can be added in any order and at any point in the process of preparing the final composition.

Methods of Using the Laundry Detergent Composition

The present invention is directed to a method of cleaning fabric, the method comprising the steps of: (i) providing a laundry detergent as described above; (ii) forming a laundry liquor by diluting the laundry detergent with water; (iii) washing fabric in the laundry liquor; and (iv) rinsing the fabric in water, wherein after 2 or less rinses, preferably after 1 rinse, the laundry liquor is substantially free of suds, or at least 50%, preferably at least 70%, more preferably 80%, and even more preferably at least 90% of a surface area of the laundry liquor is free from suds.

The present invention is also directed to a method of saving water during laundering, the method comprising the steps of: (i) providing a laundry detergent as described above; (ii) diluting the cleaning composition with wash water in a container to form a laundry liquor; (iii) washing laundry in the laundry liquor; and (iv) rinsing the laundry, wherein after 2 or less rinses, preferably after 1 rinse, the laundry liquor is substantially free of suds.

The method of laundering fabric may be carried out in a top-loading or front-loading automatic washing machine, or can be used in a hand-wash laundry application, which is particularly preferred in the present invention.

Test Methods

Test 1: Wash Suds Height and Rinse Suds Height Measurement

The detergent compositions of the present invention generate an optimal suds profile that is a combination of just enough suds in the wash, while minimizing suds in the rinse. To demonstrate this profile, two methods are used to measure: (1) Wash Suds Height using a Suds Cylinder Tester (SCT); and (2) Rinse Suds Height also by using the SCT. To achieve standard testing conditions, reversed-osmosis water ("RO-water") is used, and standardized water hardness is achieved by adding sodium bicarbonate to the appropriate level to achieve suitably representative water hardness. For the purposes of this testing, the target water hardness is 16 gpg.

Wash Suds Height is measured determine suds volume generated during the washing stage by laundry detergent compositions of the present invention comprising the low levels of LAS combined with high levels of sodium carbonate with suds volume generated by one or more comparative laundry detergent compositions that do not fall within the scope of the present invention. The higher the Wash Suds Height, the better the results.

Rinse Suds Height is used to compare the suds volume remaining after rinsing of laundry detergent compositions of the present invention comprising the low levels of LAS combined with high levels of sodium carbonate with suds volume generated by one or more comparative laundry detergent compositions that do not fall within the scope of the present invention with suds volume left after rinsing by one or more comparative laundry detergent compositions that do not fall within the scope of the present invention. The lower the Rinse Suds Height, the better the results.

The suds volume of the respective laundry detergent compositions can be measured by employing a suds cylinder tester (SCT). The SCT has a set of 8 cylinders. Each cylinder is a columniform plastic cylinder of about 66 cm in height and 50 mm in diameter, with rubber stopple for airproofing independently rotated at a rate of 21-25 revolutions per minute (rpm). The external wall of each cylinder contains markings for heights, with 0 mm starting from the top surface of the cylinder bottom and ending with 620 mm as the maximum measurable height.

For each suds volume measurement, a test solution is first poured into one of the cylinders in the SCT, which is then rotated for a number of revolutions as specified below, and then stopped. The suds height of the test solution inside the cylinder is read at about 1 minute after the rotation of the SCT is stopped. The suds height is calculated as the height of the top layer of suds minus the height of the test solution in the cylinder. The height of the top layer of suds is determined by the imaginary line that is at the highest point in the column of suds that passes through suds only without intersecting air and it is vertical to the cylinder wall. Scattered bubbles clinging to the interior surface of the cylinder wall are not counted in reading the suds height.

The Wash Suds Height is an average of four measurements taken after four sets of SCT revolutions. The Wash Suds Height is obtained by dissolving 2.1 g of a sample liquid laundry detergent composition into 300 ml of RO-water adjusted to 16 gpg hardness. The concentration of the laundry detergent solution being measured is 7000 ppm. The 300 ml 7000 ppm laundry detergent solution is then poured into one of the SCT cylinders and the first set of revolutions is started. The first set of SCT revolutions is 10 revolutions. After 10 revolutions the SCT is stopped to allow reading of the suds height. Subsequently, the SCT is rotated for another 3 sets of 20 revolutions (70 revolutions in total) and stopped to allow reading of the suds height after every 20 revolution. Average of suds height in each reading is calculated as flash suds generation. Cooked Peanut oil (0.125 ml) and Beijing clay particle (0.4 g) was added after 70 revolutions. The SCT is then rotated for another set of 20 revolutions and stopped to allow reading of the suds height. Another batch of Cooked Peanut oil (0.125 ml) and Beijing clay particle (0.4 g) was added. The SCT is finally rotated for another set of 20 revolutions and then stopped to allow reading of the suds height. The average of all 2 readings at 90, and 110 revolutions was recorded as suds mileage.

For measuring Rinse Suds Height, 37.5 ml of the previously mentioned 7000 ppm laundry detergent solution used for the Wash Suds Height measurement is poured from the SCT cylinder into a clean beaker, and is further diluted with another 262.5 ml RO-water adjusted to 16 gpg to simulate rinse condition. The SCT cylinder containing the 300 ml Rinse solution is rotated for 20 revolutions (130 revolutions in total) and stopped to allow reading of the suds height. The SCT is then rotated for another 20 revolution to read the suds height (150 revolutions in total). Average of the reading at 130 and 150 resolution is recorded as rinse suds volume.

Test 2: Phase Stability Test

Phase stability was observed by observing whether or not the product is isotropic, i.e., with no visible phase separation when placed at 5° C., 22° C., 40° C. and under atmospheric pressure for at least 24 hours or more. If the solution is not isotropic and shows visible phase separation under the above-mentioned test conditions, it is classified as an unstable sample. Preferably, the inventive detergent compositions of the present invention are provided as stable, single-phase liquid products with no phase separation at all three test temperatures and under atmospheric pressure for at least 24 hours or more.

EXAMPLES

Example I

Exemplary Liquid Detergent Composition

Six (6) exemplary liquid laundry detergent compositions A-F containing low levels of LAS and high levels of sodium carbonate as specified hereinabove for the present invention are formed by the following steps:

1. First creating the solvent environment by adding water, glycerin, propylene glycol, and the like.
2. Adding citric acid and MEA.
3. Adding polymers taking advantage of the heat generated by the neutralization reaction between citric acid and MEA.
4. Adding surfactants and mixing well.
5. Adjusting the pH of the mixture to greater than 7 and then adding sodium carbonate.
6. Adding aesthetics (perfume, dye, and the like) and balancing the formulation to 100% with water.

The compositional breakdowns of these 6 exemplary liquid laundry detergent compositions are provided as follows:

TABLE I

| Ingredients (wt %) | A | B | C | D | E | F |
|---|---|---|---|---|---|---|
| AES[1] | — | 0.5 | — | — | — | — |
| AS[2] | 10.00 | 3.00 | 4.00 | 2.00 | 3.00 | — |
| LAS (MEA or 2-AP) | 6.00 | 12.00 | 10.00 | 13.00 | 12.00 | 14.00 |
| AE[3] | — | — | — | 0.60 | 0.5 | — |
| Citric Acid | 5.00 | 1.98 | — | 2 | — | — |
| Boric Acid | — | 1.00 | 3.00 | — | 3.00 | — |
| Amine Oxide[4] | 1.20 | — | 0.50 | — | 0.50 | — |
| Trimethyl Lauryl Ammonium Chloride | — | 0.5 | — | — | — | — |
| $C_{12}$-$C_{18}$ Fatty Acids | — | 1.20 | — | — | — | — |
| Protease[5] (54.5 mg/g) | 7.62 | 7.98 | 2.08 | 2.08 | 2.08 | — |
| Amylase[6] (29.26 mg/g) | 2.54 | 2.67 | 0.69 | 0.69 | 0.69 | — |
| Xyloglucanase[7] | — | — | 0.15 | 0.15 | 0.15 | — |
| Borax | 4.72 | 4.94 | — | — | — | — |
| Calcium Formate | 0.15 | 0.16 | 0.16 | 0.16 | 0.16 | 0.16 |
| Ethoxylated Polyethylenimine[8] | 1.65 | 1.73 | 0.25 | 1.00 | 0.5 | 0.5 |
| Amphiphilic polymer[9] | — | 1.50 | 4.36 | 0.5 | 4.36 | 0.5 |
| Hexamethylene diamine (ethoxylated, quaternized, sulfated)[10] | — | — | 1.68 | — | 1.68 | — |
| DTPA[11] (50% active) | 0.28 | 0.30 | 0.64 | 0.28 | 0.64 | 0.28 |
| Optical Brightener[12] | 0.34 | 0.37 | 0.36 | 0.24 | 0.36 | 0.24 |
| Ethanol | 0.97 | 4.10 | 2.99 | — | 2.99 | — |
| Glycerin | 10 | 12 | 8 | 10 | 10 | 12 |
| Propylene Glycol | 4.90 | 5.16 | 8.49 | 23 | 8.49 | 23 |
| Diethylene Glycol | — | — | 4.11 | — | 4.11 | — |
| Monoethanolamine (MEA) | 1.12 | 1.17 | 0.23 | 5.00 | 0.23 | 5.00 |
| Caustic Soda (NaOH) | 3.50 | 3.74 | 2.10 | — | 2.10 | — |
| Na Formate | 0.61 | 0.64 | 0.23 | 0.23 | 0.23 | 0.23 |
| Carbonate | 5 | 5.6 | 4.5 | 5.6 | 4.5 | 5.6 |

TABLE I-continued

| Ingredients (wt %) | A | B | C | D | E | F |
|---|---|---|---|---|---|---|
| Na Cumene Sulfonate | — | — | 1.00 | 1.00 | 1.00 | — |
| Suds Suppressor | — | — | 0.18 | 0.18 | 0.18 | 0.18 |
| Dye | 0.01 | — | 0.02 | 0.02 | 0.02 | 0.02 |
| Perfume | 0.85 | — | 1.00 | 1.00 | 1.00 | 1.00 |
| Preservatives[13] | 0.05 | 0.50 | — | — | — | — |
| Hydrogenated castor oil | — | — | 0.27 | 0.27 | 0.27 | — |
| Water | Q.S. | Q.S. | Q.S. | Q.S. | Q.S. | Q.S. |

[1]AES can be $AE_1S$, $AE_{1.5}S$, $AE_2S$, and/or $AE_3S$, in the amount ranging from 0-20%.

[2]Linear or branched $C_8$-$C_{18}$ AS, such as cocoyl AS, palmityl AS or Isalchem 123 ®.

[3]AE is a $C_{12}$-$C_{14}$ alcohol ethoxylate with an average degree of ethoxylation of 7-9, supplied by Huntsman, Salt Lake City, Utah, USA.

[4]$C_8$-$C_{18}$ amine oxide.

[5]Proteases may be supplied by Genencor International, Palo Alto, California, USA (e.g., Purafect Prime ®, Excellase ®) or by Novozymes, Bagsvaerd, Denmark (e.g. Liquanase ®, Coronase ®).

[6]Available from Novozymes, Bagsvaerd, Denmark (e.g., Natalase ®, Mannaway ®).

[7]Available from Novozymes (e.g., Whitezyme ®).

[8]Polyethyleneimine (MW = 600) with 20 ethoxylate groups per —NH.

[9]Random graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units, available from BASF as Sokalan PG101 ®.

[10]A compound having the following general structure: bis($(C_2H_5O)(C_2H_4O)_n$)($CH_3$)—$N^+$—$C_xH_{2x}$—$N^+$—($CH_3$)—bis($(C_2H_5O)(C_2H_4O)_n$), wherein n = from 20 to 30, and x = from 3 to 8, or sulphated or sulphonated variants thereof, available from BASF as Lutenzit Z 96 ®

[11]DTPA is diethylenetriaminepentaacetic acid supplied by Dow Chemical, Midland, Michigan, USA.

[12]Suitable Fluorescent Whitening Agents are for example, Tinopal ® AMS, Tinopal ® CBS-X, Sulphonated zinc phthalocyanine Ciba Specialty Chemicals, Basel, Switzerland. It can be provided in the amount ranging from 0-5%.

[13]Suitable preservatives include methylisothiazolinone (MIT) or benzisothiazolinone (BIT), which can be provided in the amount ranging from 0-1%.

Example 2

Comparative Tests of Sudsing Profile

Four (4) test samples of liquid laundry detergent compositions are prepared using a common base formulation that contains about 23 wt % 1,2-propanediol, about 10 wt % glycerin, about 2.2 wt % citric acid, and about 5 wt % monoethanolamine (MEA). The first test sample is the Control Sample containing only LAS, without AES or carbonate and having a relatively low pH value of about 7.5. The second sample is the Inventive Sample containing LAS in combination with sodium carbonate and having a relatively high pH value of about 9.5. The third sample is the Comparative Example 1 containing LAS in combination with AES without sodium carbonate, which is characterized by a relatively low pH value of about 7.5. The fourth sample is the Comparative Sample 2 containing LAS without AES or sodium carbonate, but with a relatively high pH of about 9.5 adjusted by NaOH.

The detailed compositional breakdowns of these 4 test samples and their corresponding suds measurements are provided hereinafter:

| | Control (LAS alone) | Inventive (LAS + Na2CO3) | Comparative 1 (LAS + AE1S) | Comparative 2 (LAS + NaOH) |
|---|---|---|---|---|
| Ingredients | | | | |
| LAS (%) | 15 | 15 | 12 | 15 |
| AE1S | 0 | 0 | 3 | 0 |
| Propanediol | 23 | 23 | 23 | 23 |
| MEA | 5 | 5 | 5 | 5 |
| Glycerine | 10 | 10 | 10 | 10 |
| Citric Acid | 2.2 | 2.2 | 2.2 | 2.2 |
| Carbonate | 0 | 6.5 | 0 | 0 |
| NaOH | Titrate to pH = 7.5 | 0 | Titrate to pH = 7.5 | Titrate to pH = 9.5 |

-continued

| | Control (LAS alone) | Inventive (LAS + Na2CO3) | Comparative 1 (LAS + AE1S) | Comparative 2 (LAS + NaOH) |
|---|---|---|---|---|
| Measurements | | | | |
| pH | 7.5 | 9.5 | 7.5 | 9.5 |
| Flash suds (mm) | 35.4 | 39.4 | 40.4 | 37.5 |
| Suds Mileage (mm) | 18.5 | 20.8 | 37.1 | 13.6 |
| Rinse suds (mm) | 3.6 | 4.0 | 10.2 | 3.2 |

Inventive Sample containing the combination of LAS with sodium carbonate has more flash suds and better suds mileage than the Control Sample containing LAS alone, but lower rinse suds than the Comparative Example 1 containing the combination of LAS with AES. Therefore, the Inventive Sample has an improved sudsing profile overall than both the Control Sample and the Comparative Example 1, i.e., characterized by relatively high wash suds and relatively low rinse suds, which is particularly desirable for hand-wash detergent formulations. Further, the Inventive Sample also exhibits more flash suds and better suds mileage than the Comparative Sample 2, which contains LAS and having its pH value to the same level as the Inventive Sample by using NaOH. Therefore, this set of experimental results demonstrates that sodium carbonate has a surprising and unexpected impact on the sudsing profile of the LAS surfactant, which is independent of the pH value of the formulation.

Example 3

Comparative Tests of Phase Stability

Three (3) liquid laundry detergent compositions having the following ingredients are made, and their respective phase stability is tested according to the test method described hereinabove, and the test results are provided as below:

TABLE II

| | Comparative A | Comparative B | Inventive Sample |
|---|---|---|---|
| Compositions/Ingredients (wt %) | | | |
| LAS (%) | 13.9 | 13.9 | 13.9 |
| C12-C15 branched AS | 2 | 2 | 2 |
| Carbonate | 5 | 5 | 5 |
| Propanediol | 2 | 45 | 23 |
| Glycerine | 3 | 22 | 15 |
| MEA | 5 | 5 | 5 |
| Water | Balance | Balance | Balance |
| Stability Test Result (at atmosphere temperature after 24 hr) | | | |
| 5° C. | Phase Separation | Cannot be made into one phase | Stable |
| 22° C. | Phase Separation | Cannot be made into one phase | Stable |
| 40° C. | Phase Separation | Cannot be made into one phase | Stable |

The phase stability results show that when LAS and sodium carbonate are formulated into a liquid composition containing either too little or too much propanediol and glycerin, the liquid composition is not stable and will go through phase separation when the temperature varies. However, when the liquid composition contains propanediol and glycerin in appropriate amounts as described by the present invention, the phase stability Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid laundry detergent composition comprising:

(a) from 5 wt % to 20 wt % of a $C_{10}$-$C_{20}$ linear alkyl benzene sulphonate (LAS), wherein the LAS is selected from the group consisting of monoethanolamine LAS, 2-aminopropanol LAS, monoisopropanolamine LAS, 1-amino-3-propanol LAS, and combinations thereof;

(b) from 2 wt % to 10 wt % of a water-soluble alkali metal carbonate;

(c) from 5 wt % to 40 wt % of one or more solvents selected from the group consisting of diols and combinations thereof; and (d) from 4 wt % to 20 wt % of glycerin, wherein said liquid laundry detergent composition is substantially free of alkylethoxy sulfates (AES).

2. The liquid laundry detergent composition of claim 1, further comprising from 0.01 wt % to 2 wt % of a cationic surfactant selected from the group consisting of dimethyl hydroxyethyl lauryl ammonium chloride, trimethyl lauryl ammonium chloride, amido propyldimethyl amine, and combinations thereof.

3. The liquid laundry detergent composition of claim 1, further comprising from 0.01 wt % to 5 wt % of a nonionic surfactant selected from the group consisting of $C_8$-$C_{18}$ amine oxides, $C_8$-$C_{18}$ alcohol alkoxylates having an average degree of alkoxylation ranging from 1 to 20, and combinations thereof.

4. The liquid laundry detergent composition of claim 1 optionally further comprising one or more additional surfactants such that the total surfactant content is from 5 wt % to 30 wt %.

5. The liquid laundry detergent composition of claim 1, further comprising from 0.1 wt % to 10 wt % of an acid selected from the group consisting of citric acid, boric acid, and combinations thereof.

6. The liquid laundry detergent composition of claim 1, further comprising from 0.1 wt % to 5 wt % of one or more $C_{12}$-$C_{18}$ fatty acids or salts thereof.

7. The liquid laundry detergent composition of claim 1, having a pH value of from 8.5 to 13.

8. A liquid laundry detergent composition comprising:

(a) from 8 wt % to 18 wt % of a monoethanolamine LAS, monoisopropanolamine LAS, 1-amino-3-propanol LAS, and/or 2-aminopropanol LAS;

(b) from 4 wt % to 7 wt % of sodium carbonate;

(c) from 15 wt % to 35 wt % of propylene glycol;

(d) from 6 wt % to 18 wt % of glycerin; and (e) from 0.7 wt % to 5 wt % of a $C_{10}$-$C_{16}$ linear or branched AS, wherein said liquid laundry detergent composition is substantially free of alkylethoxy sulfates.

9. The liquid laundry detergent composition of claim 8, further comprising from 0.01 wt % to 2 wt % of a cationic surfactant selected from the group consisting of dimethyl hydroxyethyl lauryl ammonium chloride, trimethyl lauryl ammonium chloride, amido propyldimethyl amine, and combinations thereof.

10. The liquid laundry detergent composition of claim 8, further comprising from 0.01 wt % to 5 wt % of a nonionic surfactant selected from the group consisting of $C_8$-$C_{18}$ amine oxides, $C_8$-$C_{18}$ alcohol alkoxylates having an average degree of alkoxylation ranging from 1 to 20, and combinations thereof.

11. The liquid laundry detergent composition of claim 8 optionally further comprising one or more additional surfactants such that the total surfactant content is from 8.7 wt % to 30 wt %.

12. The liquid laundry detergent composition of claim 8, further comprising from 0.1 wt % to 10 wt % of an acid selected from the group consisting of citric acid, boric acid, and combinations thereof.

13. The liquid laundry detergent composition of claim 8, further comprising from 0.1 wt % to 5 wt % of one or more $C_{12}$-$C_{18}$ fatty acids or salts thereof.

14. The liquid laundry detergent composition of claim 8, having a pH value of from 8.5 to 13.

* * * * *